US007757918B2

(12) United States Patent
Merzon

(10) Patent No.: US 7,757,918 B2
(45) Date of Patent: Jul. 20, 2010

(54) CINCHING SHOULDER OR BACK CARRIED BAG AND METHOD

(76) Inventor: Adam Merzon, 26 Memory La., Greenwich, CT (US) 06381

( * ) Notice: Subject to any disclaimer, the term of this patent is extended or adjusted under 35 U.S.C. 154(b) by 0 days.

(21) Appl. No.: 11/700,453

(22) Filed: Jan. 31, 2007

(65) Prior Publication Data

US 2008/0023512 A1 Jan. 31, 2008

Related U.S. Application Data

(60) Provisional application No. 60/764,221, filed on Feb. 1, 2006.

(51) Int. Cl.
*A45F 3/02* (2006.01)

(52) U.S. Cl. ..... 224/602; 224/250

(58) Field of Classification Search ..... 224/600–622, 224/627, 631, 644, 645, 647, 654, 628, 250; 294/150, 151, 164; *A45F 3/02, 3/14*
See application file for complete search history.

(56) References Cited

U.S. PATENT DOCUMENTS 1,082,017 A * 12/1913 Feinen ..... 294/149
4,061,259 A * 12/1977 Hurst ..... 294/151
4,887,752 A * 12/1989 Nauta ..... 224/621
5,586,705 A * 12/1996 Leonard ..... 224/631
6,152,343 A * 11/2000 Shin ..... 224/645
6,328,192 B1 * 12/2001 Sundara et al. ..... 224/645
D460,620 S * 7/2002 Smithey ..... D3/315
6,655,564 B1 * 12/2003 Zupan ..... 224/628
6,793,112 B2 * 9/2004 Ammerman ..... 224/607
6,889,882 B1 * 5/2005 Leep ..... 224/579
7,303,102 B2 * 12/2007 Werts ..... 224/607
2008/0030015 A1 * 2/2008 Merzon ..... 281/45
2009/0242601 A1 * 10/2009 Inman ..... 224/602

* cited by examiner

*Primary Examiner*—Nathan J Newhouse
*Assistant Examiner*—Justin M Larson
(74) *Attorney, Agent, or Firm*—Stephen Cannavale, Esq.

(57) ABSTRACT

The present invention relates to a back or shoulder carried bag or case that includes a support strap supported on part of a back or shoulder of a person carrying the bag or case comprising a back support surface disposed toward the back of the person that includes a support strap cinching arrangement.

8 Claims, 7 Drawing Sheets

CINCHING SHOULDER OR BACK CARRIED BAG AND METHOD

CROSS-REFERENCE TO RELATED APPLICATIONS

The present application claims priority to Provisional Application No. 60/764,221, filed Feb. 1, 2006, and entitled, "CINCHING SHOULDER OR BACK CARRIED BAG AND METHOD", herein incorporated by reference.

FIELD OF THE INVENTION

The present invention relates to a shoulder or back carried bag or case, preferably a book holder and more preferably a book sling, which includes at least one cinching arrangement that facilitates receipt and retention of one or more books in a pocket of the book sling as well as a method cinching to help securely and stably retain the one or more books in the book sling pocket when carried on the back or shoulder of a person.

DESCRIPTION OF THE DRAWINGS

The drawings illustrate the best mode currently contemplated as practicing the present invention. One or more preferred exemplary embodiments of the invention are illustrated in the accompanying drawings in which like reference numerals represent like parts throughout and in which.

Figure 1:
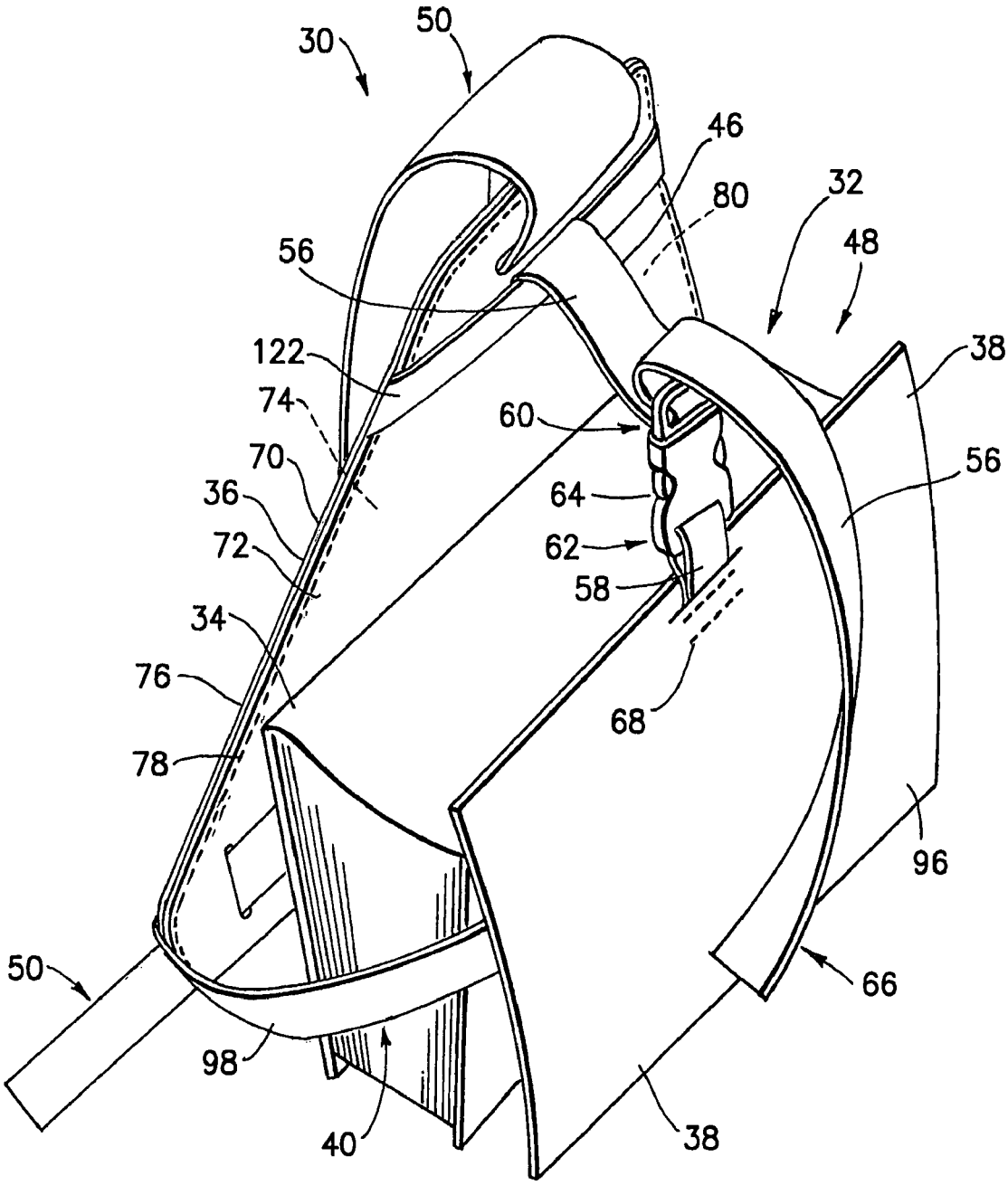
FIG. 1 is a top front perspective or isometric photo of a preferred embodiment of an "auto-cinching" book sling constructed in accordance with the present invention showing its front and holding a book.

Before explaining each embodiment of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF AT LEAST ONE PREFERRED EMBODIMENT OF THE INVENTION

Figure 2:
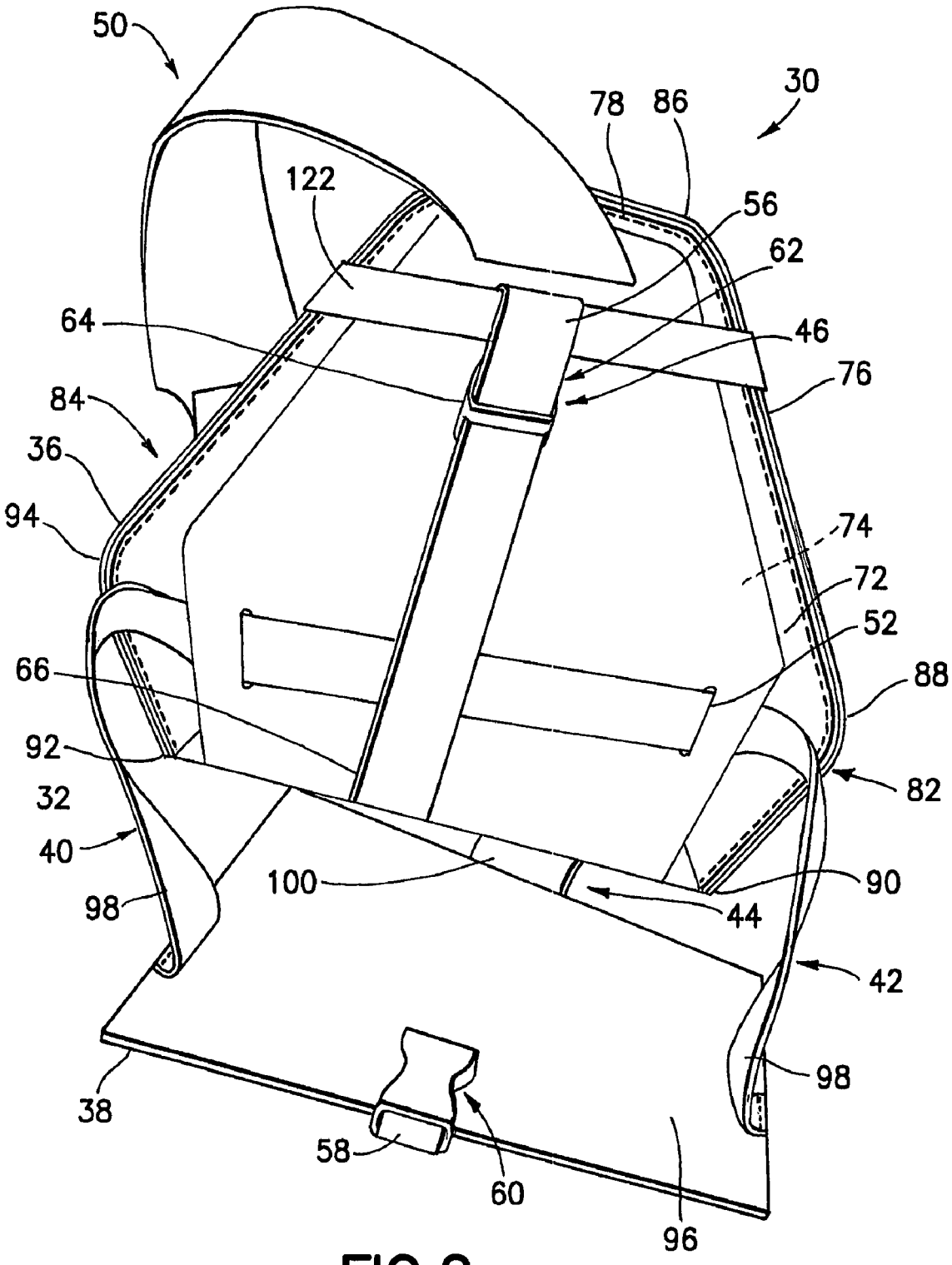
FIG. 2 is a top front perspective/isometric photo of the book sling of FIG. 1 in an empty condition.
Figure 3:
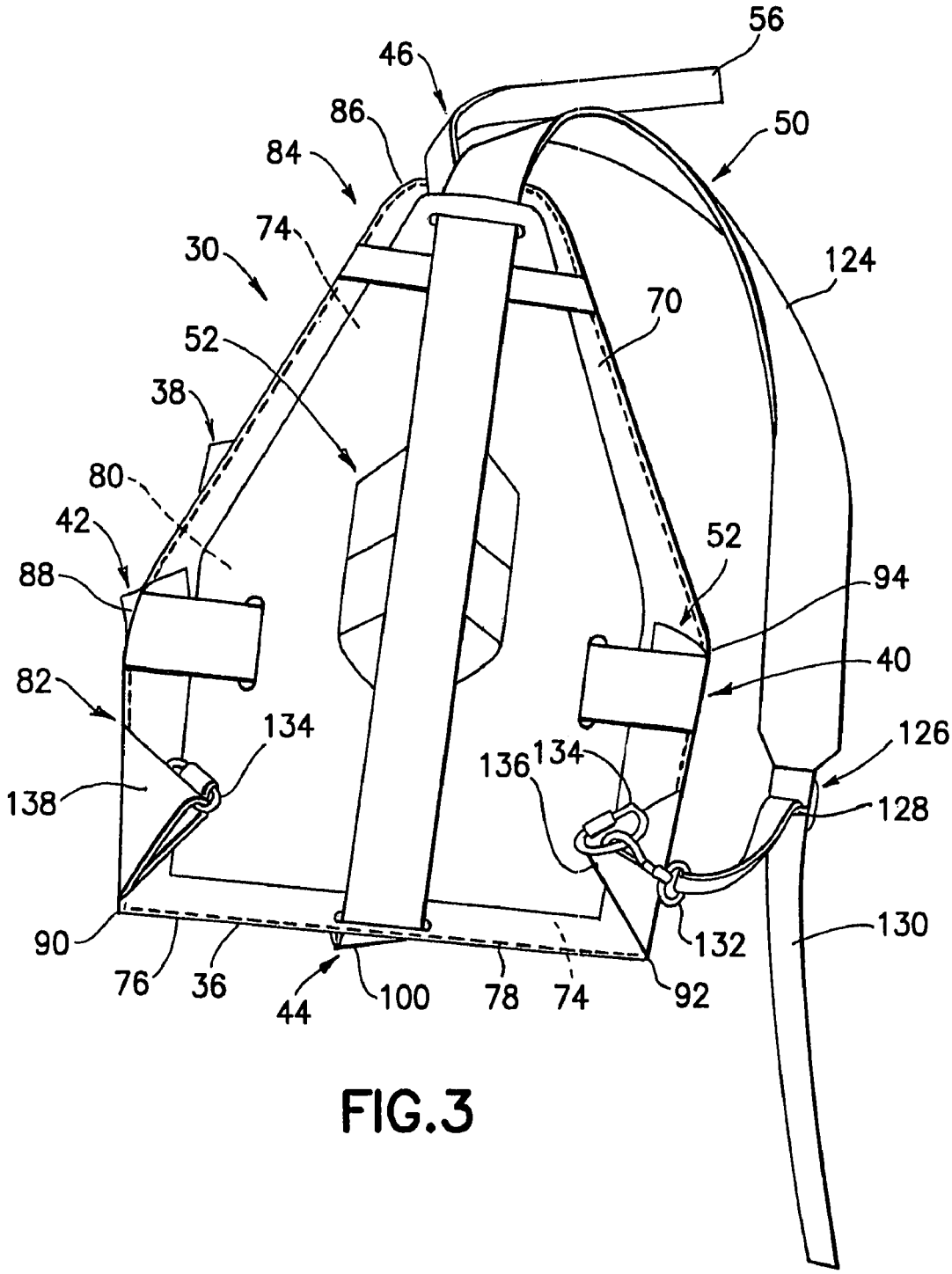
FIG. 3 is a rear plan view photo of the book sling.

FIGS. 1-3 illustrate a shoulder or back carried bag or case, preferably a book sling 30 constructed in accordance with the present invention, which includes a pocket 32 in which at least one object, preferably a book 34, is receivable. Although a single book 34 is shown in the pocket 32 in FIG. 1, the book sling 30 is capable of holding more than one book. It can also hold other types of objects as well, such as, binders, notebooks, portfolios, pamphlets, paper, etc. The pocket 32 is defined by an inner wall 36, an outer wall 38, a pair of side restraints 40 and 42 (FIG. 2), a bottom restraint 44 (FIG. 2), and a reclosable top restraint 46 that overlies a mouth 48 of the pocket 32. An adjustable shoulder strap arrangement 50 is provided to enable the book sling 30 to be supported on a shoulder of a person (not shown) as well as to allow the book sling 30 to be carried by hand.

At least a plurality of the restraints 40, 42 and 44 are anchored to one of the book sling pocket walls 36 and 38, preferably by being fixed to the wall, and are also anchored to the other one of the pocket walls 36 and 38, preferably by being part of a manually operated "auto-cinching" arrangement 52 (FIGS. 2 and 3) that is carried thereby. In the preferred embodiment shown in FIGS. 1-3, restraints 40, 42 and 44 are each fixed at or adjacent one end to the outer pocket wall 38 and they also form part of a cinching harness 54 of the cinching arrangement 52 that anchors the restraints 40, 42 and 44 to the inner pocket wall 36.

As is discussed in more detail below, the cinching arrangement 52 preferably is of "auto-cinching" construction and operation because it is configured to automatically cinch the pocket 32 about its contents, e.g., book 34, when the book sling 30 is picked up by its shoulder strap arrangement 50. It preferably is also capable of automatic cinching operation while it is being carried, including when slung over the shoulder of a person wearing it. Its cinching harness 54 preferably is disposed within the inner pocket wall 36 such that the "auto-cinching" cinching arrangement 52 preferably is advantageously integral with the wall 36. It preferably also is of integral construction with restraints 40, 42 and 44 by being connected to it. The cinching harness 54 anchors the restraints 40, 42 and 44 to the inner wall 36 in a manner capable of allowing limited movement relative to that wall 36.

In operation, when the book sling 30 is picked up by its shoulder strap arrangement 50, the countering downward force exerted on its pocket 32 from the weight of the pocket contents, e.g. book 34, causes restraint slack to be automatically taken up, drawing at least part of the pocket 32 around the pocket contents to thereby more stably and securely retaining them in the pocket 32. Operation of this cinching arrangement 52 is referred to as automatic because it is capable of automatically occurring when picking up the book sling 30. It preferably also can automatically occur when putting on the book sling 30, while carrying the book sling 30 while walking or lifting it, as well as while walking around wearing the book sling 30.

A book sling 30 of the present invention preferably is also equipped with another cinching arrangement 62 (FIG. 1) that also takes advantage of an applied force-gravity induced force differential but is of self-cinching construction as it is not capable of automatic cinching operation. It is self-cinching because it requires manual application of only a single cinching force making it capable of one handed operation. The self-cinching arrangement 62 preferably only requires one hand to operate, cinches more quickly, produces more positive cinching, and is simpler and easier to use.

This contrasts with conventional cinching arrangements (not shown) which require manual application of cinching forces along two directions to produce an opposing force differential of sufficient magnitude needed to cause cinching to occur. This requires two hands to carry out cinching, which requires more dexterity, reduces cinching times, and typically produces inconsistent cinching results.

The second cinching arrangement 62 cooperates with the top restraint 46 so that at least a top part of the pocket 32 can be cinched in a manner that preferably complements the cinching of the pocket 32 that results from operation of the automatic cinching arrangement 52. The self-cinching arrangement 62 preferably is integrated with the reclosable top restraint 46 producing a restraint that helps retain contents 34 in the pocket 32 while being quick and easy to open and close while also being of economical and compact space saving construction.

The top restraint 46 includes a pair of belts or straps 56 and 58 that engage a manually operable releasable latching arrangement 60 making the restraint reclosable. At least one of the top restraint straps 56 cooperates with the second cinching arrangement 62 preferably via engagement with a cinch adjuster 64 that can be integral with the releasable latching arrangement 60. In the preferred embodiment shown in FIGS. 1-3, the cinch adjuster 64 is integrally formed of part of the releasable latching arrangement 60. As previously discussed, this produces a dual-function restraint that is quick, simple and easy to use and which is of compact and economical construction.

The other one of the top restraint straps 58 extends between part of the releasable latching arrangement 60 and the outer pocket wall 38 of the book sling 30. The strap 58 is fixed at or adjacent one end to part of the releasable latching arrangement 60, preferably by being attached to it, e.g. looped around part of it. The strap 58 is also fixed at or adjacent its other end to the outer pocket wall 38, preferably by being attached to the wall 38 by a length, e.g., seam of stitching 68.

The cinch strap 56 of the top restraint 46 extends between another part of the releasable latching arrangement 60 and the inner book sling pocket wall 36. The strap 56 preferably also is fixed at or adjacent one end to the inner pocket wall 36. The strap 56 includes a handle strap segment 66 that is looped through the cinch adjuster 64 and extends outwardly of the adjuster 64, serving as a handle of the second "self-cinching" arrangement 62.

In operation of the second cinching arrangement 62, the handle strap segment 66 of the top restraint cinch strap 56 is grasped and lifted (or pulled), giving rise to a force opposing (a) the force of gravity inherently acting on the book sling 30 and its contents, e.g., book 34, and (b) any friction force resisting relative movement between the cinch strap 56 and the cinch adjuster 64 through which it is threaded. When the applied cinching force, preferably lifting force, becomes great enough so as to exceed at least the opposing static friction force between the top restraint cinch strap 56 and cinch adjuster 64, the strap 56 preferably is capable of slidably moving relative the adjuster 64 to enable cinching of at least the top part of the book sling pocket 32. As a result, the pocket 32 is tightened about its contents 34 thereby helping to more securely and stably retain the contents 34 in the pocket 32. Where the top restraint 46 has slack, relative movement between the strap 56 and adjuster 64 takes up part, if not all, of this slack to help tighten the pocket 32 around its contents 34.

Where the weight of the book sling 30 is great enough, simply pulling on the handle strap segment 66, e.g., handle, with enough force to overcome the opposing static friction force will preferably be sufficient to cause cinching to occur. Otherwise, where the pocket contents 34 of the book sling 30 is relatively low in mass (i.e., lightweight), a tug or jerk of the handle strap segment 66 with sufficient applied force may be all that is necessary to initiate cinching. Reducing slack in the top restraint 46 causes the space adjacent or along the mouth 48 of the book sling pocket 32 to be constricted drawing one or both pocket walls 36 and 38 more tightly around the pocket contents 34 to more stably and securely retain them.

With continued reference to FIGS. 1-3, the inner pocket wall 36 of the book sling 30 is referred to as being "inner" because it is disposed between the back or backside of a person (not shown) wearing the book sling 30 and the contents of the pocket 32. The inner pocket wall 36 includes at least one layer of a flexible material, e.g., fabric, cloth, leather, a synthetic material, such as plastic, or the like. In a preferred embodiment, the inner pocket wall 36 preferably also is of self-supporting construction such that it is at least somewhat rigid.

The inner pocket wall 36 preferably is of multi-layer construction such that it has a plurality of pairs of layers (three or more layers). For example, in the preferred embodiment shown in FIGS. 1-3, the inner wall 36 includes a first exterior layer 70 (FIG. 3) facing toward the back or backside of a person (not shown) wearing the book sling 30, a second exterior layer 72 (FIG. 2) on the opposite side that faces away from the back or backside of a person wearing the book sling 30, and a support panel 74 sandwiched between the exterior layers 70 and 72 that serves as a backbone to help impart a desired self-supporting shape to the inner wall 36.

While both exterior layers 70 and 72 can be formed of a single piece of flexible material and also be configured to be seamless, in inner wall 36 includes at least one seam preferably to join them together. For example, as is shown in FIGS. 1-3, a seam 76 extends about the periphery of the inner pocket wall 36 joining both layers 70 and 72 together. While the seam 76 can be formed using an adhesive, using a heat seal, or in another manner, the seam 76 shown in FIGS. 1-3 is formed by a line of stitching 78 that preferably extends substantially continuously about the entire periphery of the inner wall 36.

If desired, a layer of padding 80, such as an open cell or closed cell foam padding, can be included for comfort. For example, as is shown most clearly in FIG. 2, a padding layer 80 can be disposed between layers 70 and 72 so it faces toward the back or backside of a person (not shown) wearing the book sling 30. Where equipped with a padding layer 80, the padding preferably is disposed between the support panel 74 and the exterior layer 70 that faces toward the back or backside of a person (not shown) wearing the book sling 30.

While another shape can be used, the inner pocket wall 36 preferably is of irregular pentagonal shape, i.e. shaped like an apron, having a generally rectangular base 82 from which a tapered generally triangular top section 84 extends. Each corner 86, 88, 90, 92 and 94 preferably is rounded and the apex 86 of the triangular top section 84 can be truncated, if desired. When the book sling 30 is being worn, the apex 86 of the triangular section 84 points generally in an upward direction with it being oriented above the rectangular base 82.

In one preferred embodiment, the exterior layers 70 and 72 of the inner pocket wall 36 are both made of a tough, resilient and flexible material such as nylon, vinyl, GORE-TEX, canvas, or the like. The support panel 74 preferably has a shape substantially the same as or complementary to that of the shape, e.g., irregular pentagonal shape, of the inner wall 36.

The panel 74 is composed of a sheet or board substantially rigid or semi-rigid material, such as a plastic sheet, a sheet of Kraft board, or the like, which preferably has a thickness greater than the thickness of either exterior layer 70 and 72. Where made of plastic, the panel 74 can be made of a semi-crystalline, amorphous, or elastomeric thermoplastic material such as polyvinyl chloride (PVC), polypropylene, or polyethylene. In one preferred embodiment, the panel 74 has a thickness of at least a plurality of pairs, e.g., at least three, times the thickness of the thicker of either exterior layer 70 and 72. Where a layer of padding 80 is used, the layer 80 preferably is bonded, e.g., adhesively bonded, or otherwise fixed to the panel 74.

While the outer pocket wall 38 is depicted in FIGS. 1-2 as being constructed of a single generally rectangular panel 96 of same or similar construction to that of inner pocket wall panel 74, the outer pocket wall 38 can be constructed differently, if desired. For example, the outer pocket wall 38 can be composed of a plurality of layers (not shown). If desired, the outer pocket wall 38 can be of multi-layer construction (also not shown) of a configuration same as or similar to that of the inner pocket wall 36. Of course, other configurations are possible.

Each one of the side restraints 40 and 42 is constructed and arranged to retain and limit side to side movement of a book 34 received in the book sling pocket 32 to help keep it in the pocket 32. Each side restraint 40 and 42 preferably is located about halfway between, e.g., be between forty percent and sixty percent, the apex 86 of the triangular section 84 of the inner pocket wall 36 and the bottom edge of the rectangular base 82 of the wall 36 and are substantially aligned in a generally transverse direction with one another. Each side restraint 40 and 42 is made of a belt or strap 98 of flexible material that is durable, strong and tough. In a preferred embodiment, each side restraint 40 and 42 is composed of nylon having a width of at least one inch, preferably about one and seven-eighths inch, and a thickness of at least fifty mils and preferably about one hundred mils. If desired, another suitable flexible material, such as polypropylene, neoprene, or the like, can be used.

The bottom restraint 44 is constructed and arranged to underlie and restrain downward movement of a book 34 received in the pocket 32. It is located about halfway between the outside edges of the rectangular base 82 of the inner wall 36 and of an identical or like configuration as the side restraints 40 and 42. For example, the bottom restraint 44 preferably is also made of the same as or similar material, e.g., a nylon strap 100, as that of the side restraints 40 and 42.

The top restraint 46 is constructed and arranged to overlie and restrain upward movement of a book 34 received in the pocket 32. It is also located about halfway between the outside edges of the inner pocket wall base 82 and is substantially aligned in a lengthwise direction with at least part of the bottom restraint 44. The straps 56 and 58 of the top restraint 46 are each made of a material that is the same as or similar to that of the side restraints 40 and 42 and/or the bottom restraint 44. In the preferred embodiment shown in FIGS. 1-3, each strap 56 and 58 of the top restraint 46 is narrower than the side restraints 40 and 42 and bottom restraint 44. For example, in the preferred embodiment shown in FIGS. 1-3, each top restraint strap 56 and 58 has a width of at least one half inch and is preferably about one inch in width.

Each top restraint strap 56 and 58 preferably is fixed at or adjacent one end to a respective one of the pocket walls 36 and 38. While both straps 56 and 58 are preferably fixed by stitching, e.g., anchor stitching 68, attachment between strap 56 and pocket wall 36 preferably is reinforced with a gusset strip 122, or the like, that extends across the strap 56 and overlaps part of the wall 36.

The shoulder strap arrangement 50 is shown in more detail in FIG. 3. The shoulder strap arrangement 50 includes a relatively wide shoulder strap 124 that extends from the top, e.g., apex 86, of the inner pocket wall 36 to an adjuster 126, such as slider, e.g., ladder lock construction, or a tape adjuster 128. The shoulder strap 124 is made of a material same as or similar to one or more of the restraint straps. In the preferred adjustable shoulder strap arrangement shown in FIG. 3, the shoulder strap 124 is fixed to the adjuster 126 preferably by being looped around part of the adjuster.

The shoulder strap arrangement 50 includes an adjuster strap 130 of like construction that preferably is narrower than the shoulder strap 124. The adjuster strap 130 is threaded through part of the adjuster 126 in a manner that permits it to move, e.g. slide or be cinched, relative to the adjuster 126 when grasped and pulled to permit adjustment of shoulder strap tension. At or adjacent one end, the adjuster strap 130 is releasably attached by a snap hook 132 to a D-ring 134 of a generally triangular mounting flap 136 or 138 extending rearwardly from the inner pocket wall 36. The snap hook 132 preferably is of swivel construction. The adjuster strap 130, snap hook 132 and D-ring 134 are preferably all made of plastic, such as acetal or the like.

The inner pocket wall 36 preferably has a pair of mounting flaps 136 and 138 with one flap 136 being located at or adjacent one bottom corner and the other flap 138 being located at or adjacent its other bottom corner. As a result, the shoulder strap 124 can be easily positioned over either shoulder of a user simply by snapping the snap hook 132 onto the D-ring 134 of the desired mounting flap 136 or 138.

Figure 4:
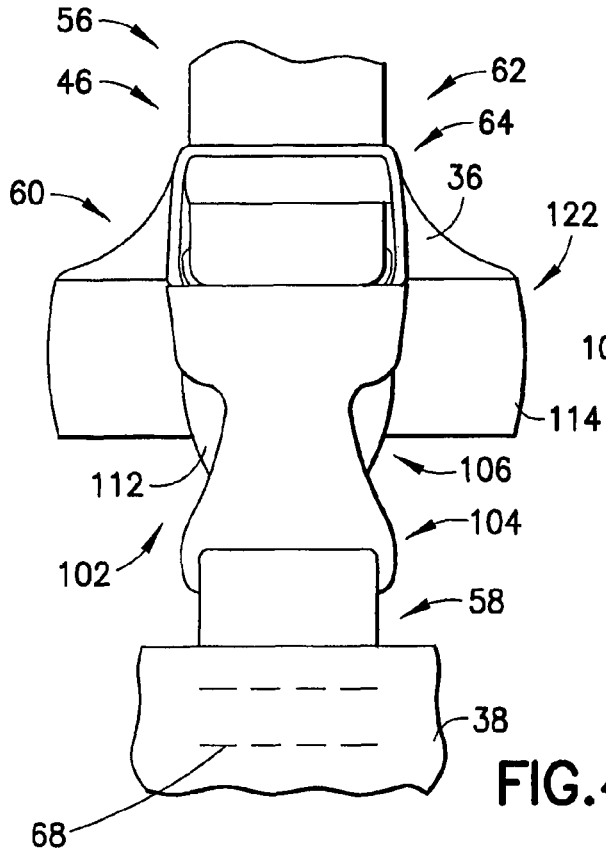
FIG. 4 is a fragmentary enlarged top plan view photo of a preferred embodiment of one pocket cinching arrangement integral that also includes a reclosable pocket mouth latching arrangement.
Figure 5:
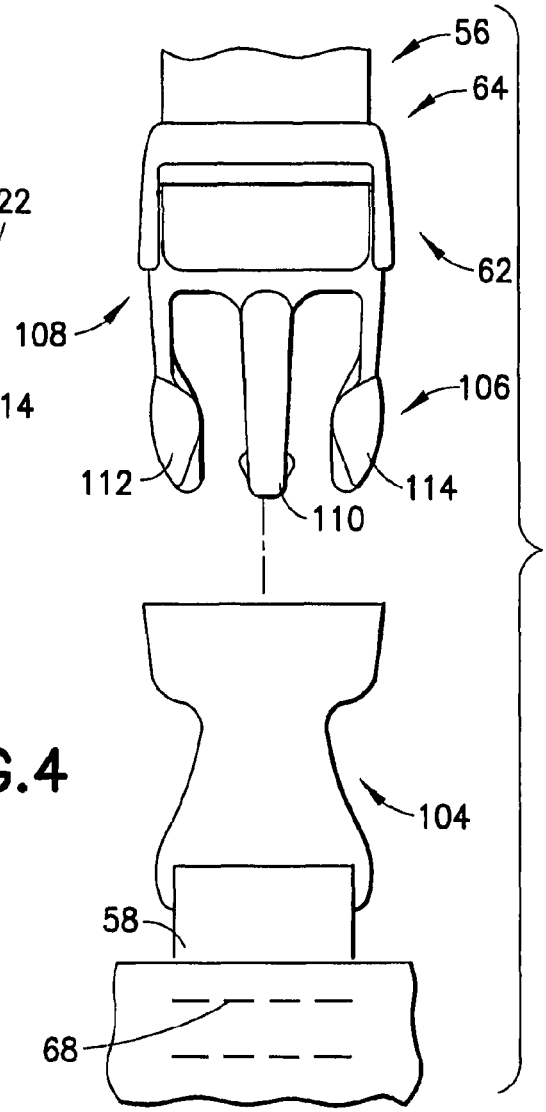
FIG. 5 is a top plan view photo depicting the releasable latching arrangement unlatched.

FIGS. 4-5 illustrate a preferred embodiment of the releasable latching arrangement 60 in more detail. The releasable latching arrangement 60 preferably is a buckle 102 of side release construction having a buckle socket 104 that releasably receives a pronged tongue 106 of a male plug 108 (FIG. 5). The tongue 106 has a center prong 110 disposed between a pair of spaced apart outer prongs 112 and 114, each of which positively engages part of the socket 104 when inserted into the socket 104 to releasably close the top restraint 46. One or both outer prongs 112 and 114 are manually pinched together to disengage the plug 108 from the socket 104 enabling the top restraint 46 to be opened. While part or the entire buckle 102 can be made of metal, it preferably is molded of plastic, e.g. nylon, an acetal, or another suitable material.

Figure 6:
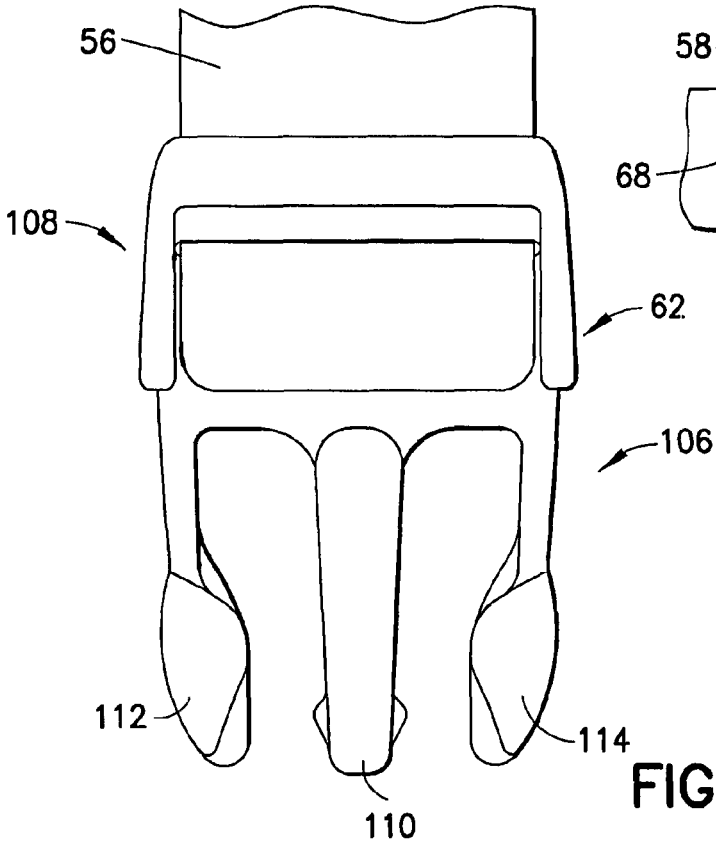
FIG. 6 is an enlarged top plan view of a cinch adjuster of the cinching arrangement depicted in FIGS. 4 and 5 and a flexible cinch strap threaded through the adjuster.

FIG. 6 illustrates the cinch adjuster 64 of the self-cinching arrangement 62 in more detail. While the cinch adjuster 64 can be separate from the buckle 102, it preferably is integrally formed of at least part of the buckle 102, such as its pronged plug 108. Where integrally incorporated as part of the buckle 102, the buckle 102 preferably is a side release cinch buckle 116 of commercially available construction.

Figure 7:
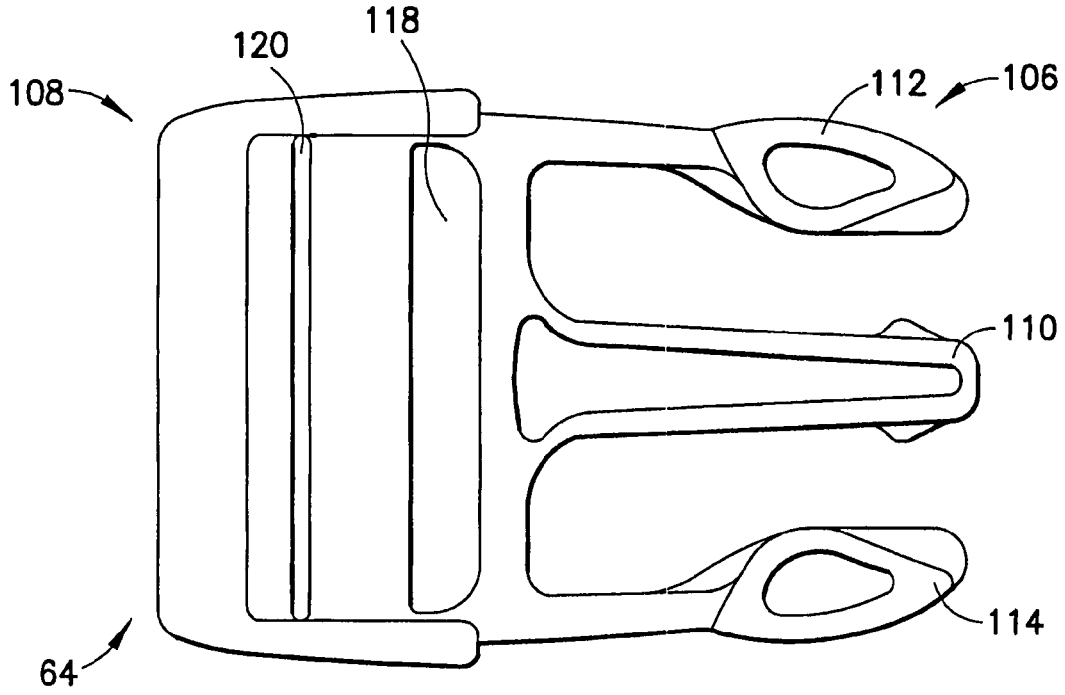
FIG. 7 is an enlarged bottom plan view of the cinch adjuster of FIG. 6.
Figure 8:
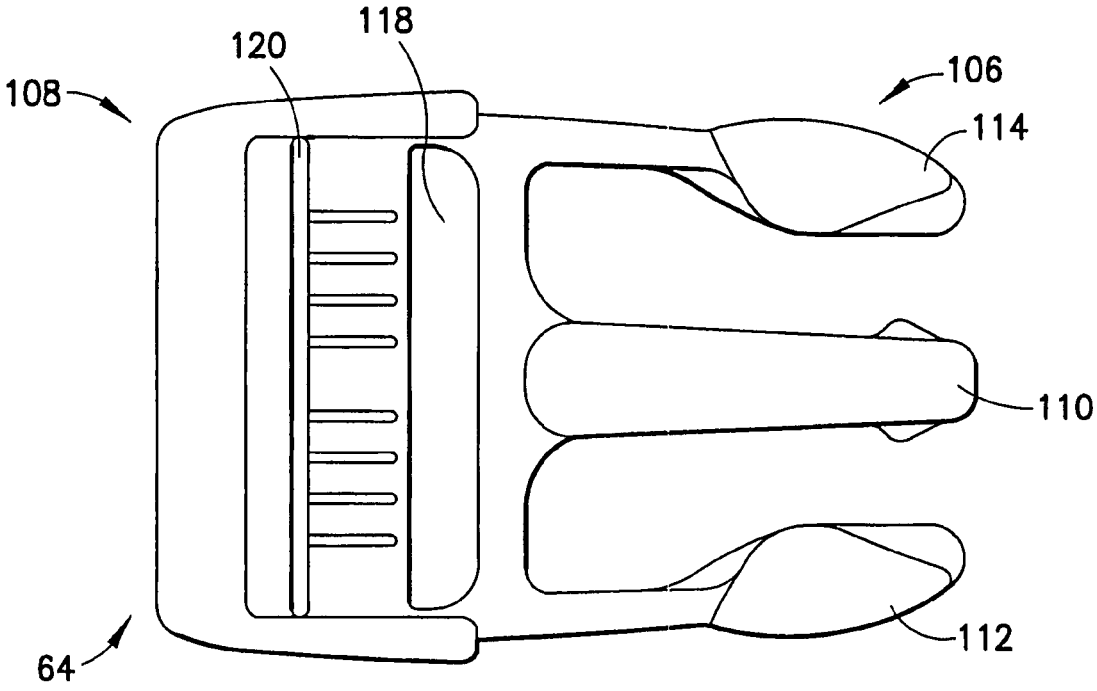
FIG. 8 is an enlarged top plan view of the adjuster of FIG. 6.

With continued reference to FIG. 6 and additional reference to FIGS. 7 and 8, in operation, part of the handle strap segment 66 of the top restraint cinch strap 56 is fed through a first slot 118 (FIGS. 7 and 8) in the cinch adjuster 64, which is the slot located closest the prongs 110, 112, and 114 of the plug 108. The end of the handle strap segment 66, i.e., strap 56, is then threaded through a second slot 120 (FIGS. 7 and 8) that is located adjacent to and parallel with the first slot 118 and pulled taut as part of setting up the cinching arrangement 62. Thereafter, pulling on the handle strap segment 66 with sufficient force, such as by applying a lifting force in the manner discussed above, will automatically, quickly and easily cinch the top restraint 46, thereby tightening the pocket 32 of the book sling 30 around its contents 34 to more stably and securely retain them in the pocket 32.

Figure 9:
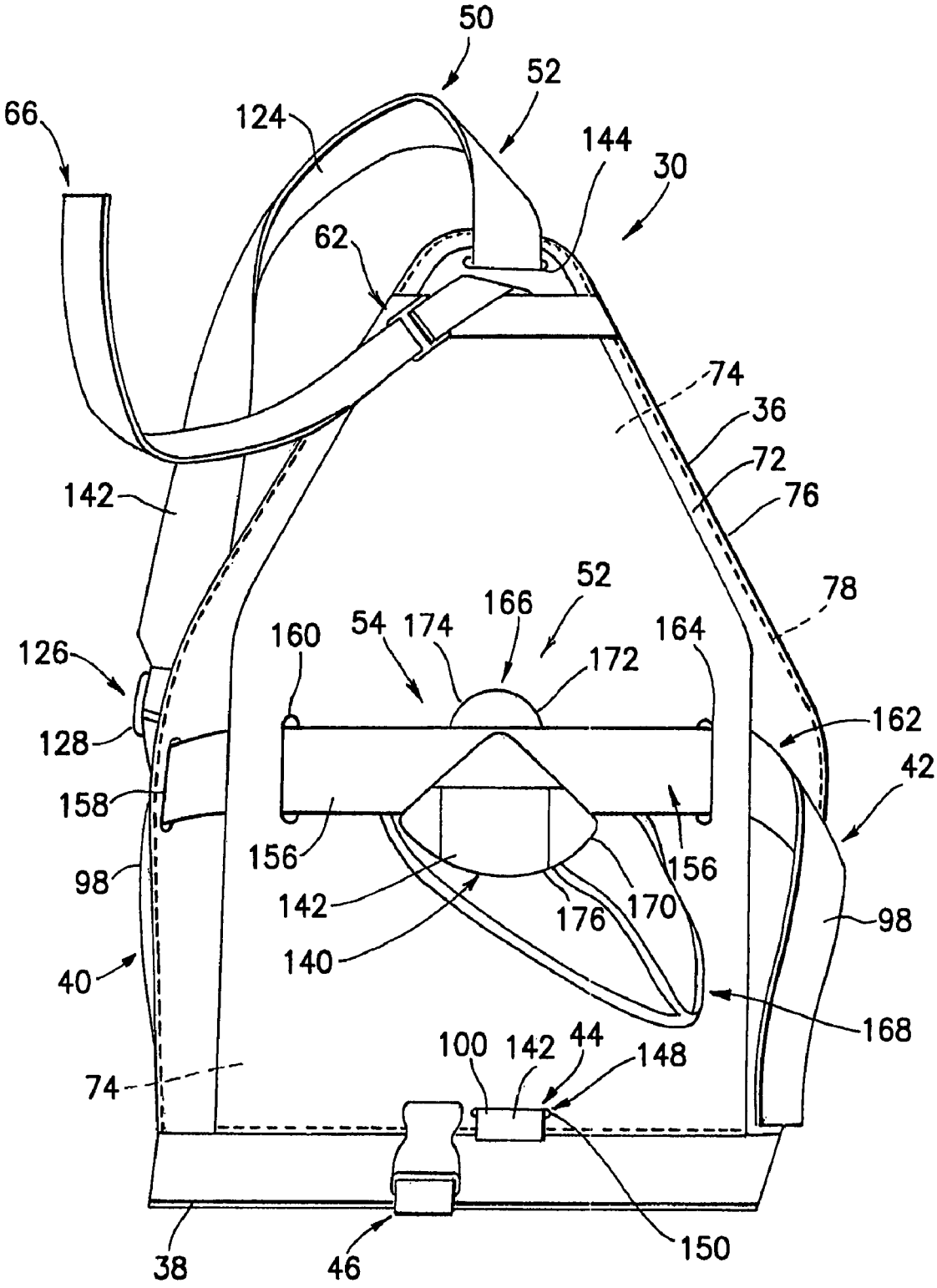
FIG. 9 is a front plan view photo illustrating an inner pocket wall of the book sling with its pocket-facing exterior surface transparent for clarity to show a preferred embodiment of a second cinching arrangement.
Figure 10:
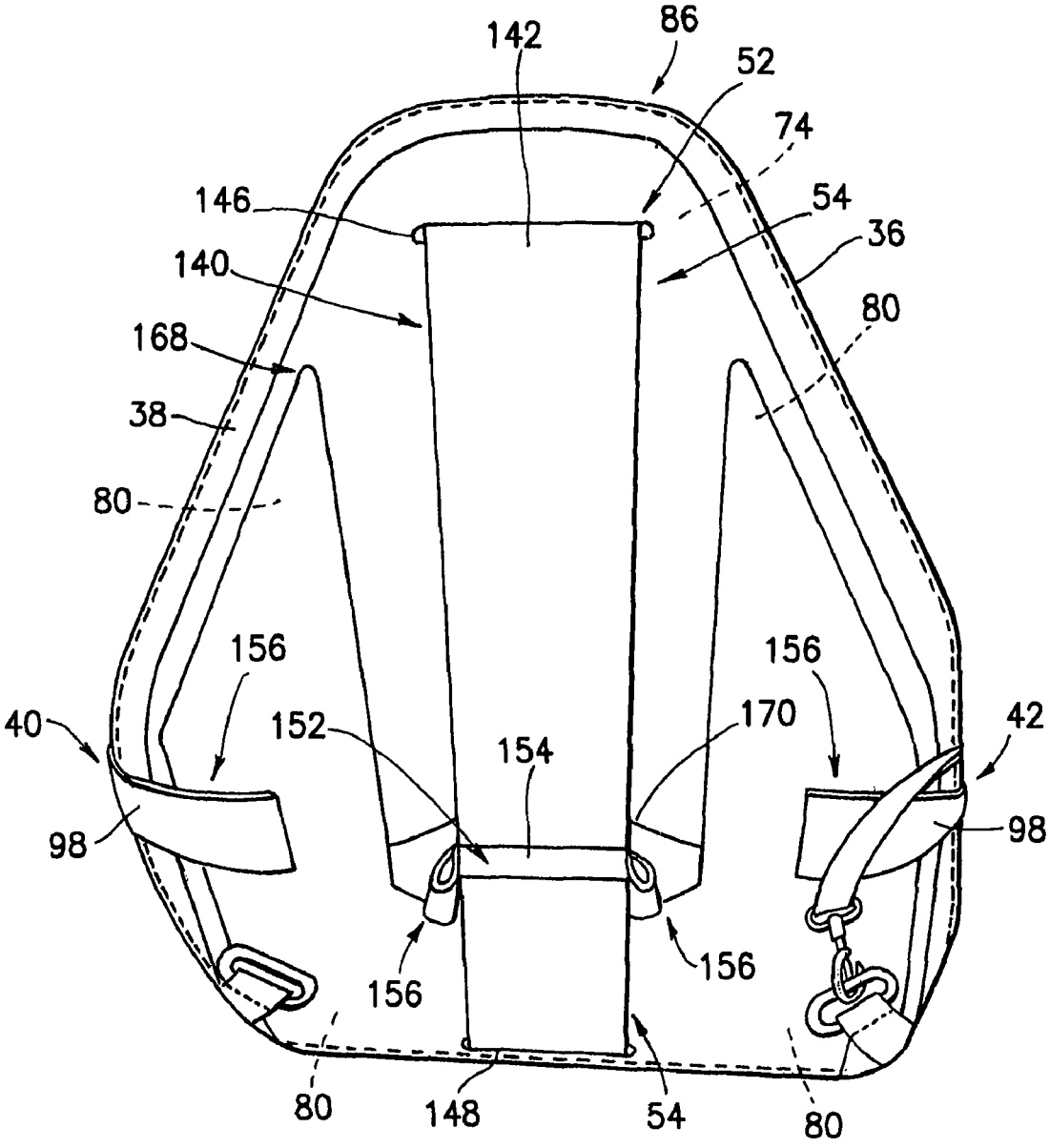
FIG. 10 is a rear plan view of the inner pocket wall of FIG. 9 also having its exterior surface transparent for clarity showing additional details of construction and operation of the automatic cinching arrangement.

Referring once again to FIGS. 1-3, the cinching arrangement 52 is shown in more detail in FIGS. 9 and 10. As previously discussed, cinching arrangement 52 includes a cinching harness 54 that preferably is integrally formed within or as part of the inner book sling pocket wall 36. Within the inner wall 36, its support panel 74 serves as both a guide and frame for the harness 54. While the panel 74 can be fixed to one or more other components, e.g., outer wall layers 70 and 72, of the wall 36, it preferably can move at least somewhat inside the wall 36 such that it is at least somewhat movable relative to outer wall layers 70 and 72. Preferably, its movement within the inner pocket wall 36 is only constrained by a boundary defined by seam 76.

Referring additionally to FIGS. 9 and 10, the shoulder strap 124 includes a primary cinch strap segment 140 that forms part of the cinching harness 54 of the automatic cinching arrangement 52 and which extends dorsally within the inner pocket wall 36 of the book sling 30. The primary cinch strap segment 140 is connected to the bottom restraint strap 100. In a preferred embodiment, the shoulder strap 124, including the primary cinch strap segment 140, is formed of a length of belt or strap 142 that also includes the strap 100 such that the shoulder strap 124 and strap 100 can be formed of a single flexible belt or strap 142 of one-piece and unitary construction.

As is also shown in FIGS. 9 and 10, the dorsally extending cinch strap 142 of the automatic cinching arrangement 52 enters through a first generally transverse elongate slot 144 (FIG. 9) formed in one of the exterior layers 72 of the inner book sling pocket wall 36 located adjacent the top, e.g., at or near the apex 86, so as to thread the strap 142 into the interior of the wall 36. Adjacent and preferably substantially overlapping, i.e., aligned, this entranceway slot 144 is a generally complementary guide or slot 146 (FIG. 10) formed in the support panel 74 that is also located adjacent the top of the inner pocket wall 36. FIG. 10 shows the strap 142 passing through the slot 146 and extending along the panel 74 to adjacent the bottom edge of the inner pocket wall 36. The strap 142 then passes through a generally transverse elongate slot 148 (FIG. 10) in the panel 74 before it exits via a complementarily shaped exit slot 150 (FIG. 9) formed in at least one of the exterior layers 38 of the inner pocket wall 36.

As previously discussed, the portion of the dorsally extending cinch strap 142 extending outwardly from the exit slot 150 preferably forms the bottom restraint 44. As previously indicated, the free end of the bottom restraint strap 100 is fixed to the outer pocket wall 38. It preferably is fixed by being attached to the outer pocket wall 38.

A preferred embodiment of such a cinch strap 142 is shown in FIGS. 9 and 10. As is best shown in FIG. 10, the strap 142 is formed of a plurality of strap segments joined together via a seam or gusset 152 formed by stitching or otherwise bonding one of the strap segments to the other one of the strap segments along a region of overlap 154. In the preferred embodiment shown in FIGS. 9 and 10, strap 142 is formed by joining the shoulder strap 124 to the strap 100 of the bottom restraint 44 in such a manner.

Slot pair 144 and 146 preferably is substantially aligned with slot pair 148 and 150 in a lengthwise direction thereby serving to guide the primary cinch strap segment 140 of the dorsally extending cinch strap 142 so it is substantially coincident with a centerline or central axis of the inner pocket wall 36. Where equipped with a layer of padding 80 inside the inner wall 36, the padding can be formed of a plurality of sections (FIG. 10) spaced apart so as to provide clearance for the passage of part or substantially all of the cinch strap 142 where the strap 142 is disposed on the same side as the padding layer 80. In another preferred embodiment, a strap passage channel (not shown) can be formed in the padding layer 80 and/or the support panel 74 through which at least the primary cinch strap segment 140 of cinch strap 142 is threaded.

As a result, the dorsally extending cinch strap 142 of cinching arrangement 52 can slidably move relative to the inner pocket wall 36 to take up slack in at least the bottom restraint 44 preferably in a self-cinching or automatic cinching manner. For example, when the shoulder strap 124 is grasped and the book sling 30 lifted, it along with its dorsally extending primary cinch strap segment 140 can move, e.g., slide, relative to the inner pocket wall 36 in response to the weight of one or more books, e.g., book 34, and the applied lifting force, automatically reducing the length of the bottom restraint 44 so it more closely approximates the width or thickness of the book or books disposed in the book sling pocket 32. As a result, the spacing between the pocket walls 36 and 38 is reduced, which thereby better conforms the pocket 32 around the pocket contents to more securely and stably retain the contents in the pocket 32.

Each side restraint strap 98 communicates with a transversely extending cinch strap segment 156 that also is part of the cinching harness 54 of the automatic cinching arrangement 52. Each strap 98 includes transverse cinch strap segment 156. Each strap 98 passes through a corresponding generally lengthwise oriented elongate slot in one of the exterior layers 70 and 72 of the inner pocket wall 36 as well as through a substantially aligned complementary slot in the support panel 74. In the preferred embodiment shown in FIGS. 9 and 10, one pair of cooperatively aligned or overlapping slots 158 and 160 is disposed along or adjacent one side of the inner pocket wall 36 and another pair of such slots 162 and 164 is disposed along or adjacent the other side of the inner pocket wall 36.

The transverse cinch strap segment 156 of each side restraint 40 and 42 communicates with the dorsally extending primary cinch strap segment 140, preferably by being fixed thereto. In one preferred embodiment, the transverse cinch strap segment 156 of each side restraint 40 and 42 is fixed by being stitched or otherwise sewn to the primary cinch strap segment 140 along a region of overlap 166 therewith. In a preferred embodiment, each side restraint strap 98 and its respective transverse cinch strap segment 156 are formed of a single flexible strap or belt of one-piece and unitary construction that is attached at or adjacent one end to the dorsally extending primary cinch strap segment 140. For example, in the preferred embodiment shown in FIGS. 9 and 10, both side restraint straps 98 include an integral transverse cinch strap arrangement 156 preferably collectively made of a single belt or strap of one-piece and unitary construction that is attached at or adjacent its midpoint to the primary cinch strap segment 140.

The support panel 74 also advantageously serves as an automatic cinching arrangement anchoring slide adjuster 168, e.g. bar type adjuster, that permits each one of the straps 98 and 100 of the restraints 40, 42 and 44, along with the shoulder strap 124, to cooperate with one another and move relative to the panel 74 as the cinching harness 54 moves relative to the panel 74 during operation via its adjuster slots 146, 148, 160 and 162 to automatically cinch one or more (preferably all) of restraints 40, 42 and 44, causing one and preferably both pocket walls 36 and 38 to more securely and stably retain the pocket contents 34 in the pocket 32. Its apertures 146, 148, 160, 162 and 170 (discussed below) guide strap movement during cinching arrangement operation to facilitate essentially automatic operation of cinching arrangement 52.

With continued reference to FIGS. 9 and 10, the shoulder strap 124, along with primary cinch strap segment 140, moves relative to the panel 74 in a direction that preferably is the same as or generally parallel to the direction of applied lifting force. As a result, the cinch strap 142 (which includes shoulder strap 124, primary cinch strap segment 140 and strap 100 of the bottom restraint 44) moves relative to the panel 74 such that it moves upwardly away from the bottom of the book sling 30. As relative movement occurs, it pulls the strap 98 of each side restraint 40 and 42 generally upwardly with it via a side restraint cinch strap guideway 170 formed in the panel 74, i.e., integral cinch adjuster 168, preferably at or adjacent its center. The guideway 170 is constructed and arranged to help guide the transverse cinch strap segment 156 of each side restraint strap 98 sideways and then, to the extent needed, upwardly along the same general direction as the dorsally extending cinch strap 142 moves when lifting-force is applied.

The transverse cinch strap guideway 170 includes a pair of transverse cinch strap guide edges 172 and 174 (FIG. 9), each of which is acutely angled relative a lengthwise extending center axis or center line of the inner pocket wall 36. Each guide edge 172 and 174 preferably has the same length and is oriented at the same angle relative the center axis or center line thereby helping to impart a generally triangular shape to the guideway 170. Such a configuration helps guide a corresponding transverse cinch strap segment 156 of one of the side restraints 40 or 42 in a manner that prevents the strap segment 156 from binding or knotting when upward dorsal cinch strap 142 displacement causes each transverse cinch strap segment 156 to be pulled and thereby displaced also in a generally upward direction. For example, FIG. 9 shows part of each transverse cinch strap segment 156 folded about its corresponding guideway guide edge 172 or 174, e.g. at about a 45° angle, and FIG. 10 shows part of these strap segments 156 after being through the transverse cinch strap guideway 170. Each guide edge 172 and 174 of the guideway 170 preferably is oriented at an angle of between 30 and 60. In the preferred embodiment shown in FIGS. 9 and 10, it preferably is disposed at about 45°±5°. While the bottom edge 176 of the guideway 170 can be substantially straight, it preferably is bowed outwardly and curved as shown in FIG. 9, such as to help facilitate smooth side restraint cinch strap segment movement during operation.

In operation, as the shoulder strap 124 is grasped and lifted, a force resulting from gravity acting on the book sling 30, including in particular its pocket contents 34, opposes the manually applied lifting force. When the force differential between the lifting force and gravity induced force becomes great enough to overcome friction, e.g. static friction, between cinching harness straps 142 and 156 and the panel 74, at least one of the straps 142 begins moving relative to the panel 74.

Even if no movement occurs, the resultant force differential increases tension in at least one of the restraint straps that are connected to the cinching harness. Increased tension, in turn, causes one or both pocket walls 36 and 38 to more tightly clamp against the contents 34 of the pocket 32. Doing so obviously helps retain the contents in the pocket. For example, greater clamping force prevents movement of the pocket contents relative to the pocket which advantageously means the contents are more stably and securely retained.

Where strap movement does occur during automatic cinching, displacement of the cinch strap 142 during automatic cinching causes the length of at least the strap 100 of the bottom restraint 44 to be reduced. This, in turn, pulls an adjacent part of the outer pocket wall toward the inner pocket wall such that it preferably bears against at least part of the contents 34 of the pocket 32. Doing so not only helps clamp the pocket contents in the pocket, it also helps conform part of at least one of the pocket walls 38 around the pocket contents 34 which can help positively retain the pocket contents in the pocket by, at least in some instances, directly interfering with pocket contents movement.

As the shoulder strap 124 moves during lifting, displacement of the primary cinch strap segment 140 relative to the support panel 74 occurs. As cinch strap segment 140 displacement occurs, it preferably pulls and displaces the transverse cinch strap segment 156 that is connected an associated strap 98 of the corresponding side restraint 40 and 42. While this shortens or at least tightens each side restraint 40 and 42 in a manner that corresponds to primary cinch strap segment 140 displacement, such as by being proportional thereto, it at least tightens the tension exerted by each side restraint 40 and 42. Where actual side restraint displacement occurs, any slack in the side restraints 40 and 42 preferably is taken up causing at least an adjacent portion of the outer pocket wall to be pulled toward the pocket contents 34. This too helps increase stable and secure retention of the pocket contents, preferably for at least the same reasons as previously discussed above.

Depending on its construction, weight of the pocket contents, static and dynamic strap friction, as well as quite possibly other factors, automatic cinching preferably can also take place while the book sling 30 is being worn. For example, as a person wearing the book sling 30 strides, the aforementioned force differential produced, albeit in smaller magnitudes, can also cause automatic operation of the cinching arrangement 52. While it is anticipated cinching increments and/or increases in cinching forces will be smaller because of correspondingly smaller force differentials, even such incremental cinching, particularly over time, is advantageous as it can further increase pocket contents retaining stability and security. In at least some instances, it can also help better conform the pocket 32 to the shape of the contents 34 by pulling one or both pocket walls 36 and 38, which preferably are each somewhat flexible, around and about the pocket contents 34.

If desired and to the extent needed, the self-cinching arrangement 62 is user: to cinch the top restraint 46 to shorten its length enough to pull at least part of the outer pocket wall 38 toward the pocket wall 36 helping to more stably and securely retain pocket contents 34 in the pocket 32. It too can also help conform the shape of the pocket 32 relative to its pocket contents 34. If desired, the cinching arrangement 62 can be operated before performing automatic cinching using the aforementioned cinching arrangement 52. It also can be operated afterwards if desired.

Of course, substantially simultaneous operation is contemplated as being within the scope of the present invention. For example, in one preferred book sling embodiment, the cinching arrangements 52 and 62 cooperate with one other preferably in a complementary fashion. In one preferred embodiment not shown in the drawings, the cinching arrangements 52 and 62 are interconnected in a manner that permits cinching operation of one cinching arrangement, such as preferably cinching arrangement 52, to control or otherwise impact operation of the other cinching arrangement 62.

In one preferred embodiment (not shown), some part of the cinch strap 56 of the top restraint 46, such as its handle strap segment 66, is connected to some part of the cinching harness 54 of the cinching arrangement 52. When the book sling 30 is lifted or carried, cinching harness displacement can also cause displacement of the cinch strap 56 of the top restraint 46 such that both cinching arrangements 52 and 62 are capable of communication during operation.

In one embodiment, the handle strap segment 66 can cooperate with the shoulder strap 124 in a manner where shoulder strap displacement can cause it to displace, including by a like amount or magnitude, such that cinching of the top restraint 42 can occur substantially simultaneously with automatic cinching via cinching arrangement 52. While cooperation can be accomplished via engagement between the handle strap segment 66 and shoulder strap 124, other types and ways of cooperation are contemplated as being within the scope of the invention. Engagement can be direct, such as via attachment using hook and loop fastener strips, e.g. VELCRO, stitching, gusseting, bonding, etc.

Engagement can also be carried out in a manner that does not necessarily need to fix or actually immovably fix the handle strap segment 66 to some part of the :inching harness 54 of the automatic cinching arrangement 52. For example, a buckle and/or a slide adjuster (not shown), e.g., bar-type slide adjuster or slide adjuster buckle, can be used to releasably engage it with the shoulder strap 124. Other arrangements, including those facilitating indirect engagement, can be employed.

In one preferred embodiment (not shown), the handle strap segment 66 of the top restraint self-cinching arrangement 62 is fixed to the shoulder strap 124 such that picking up the book sling 30 by the shoulder strap 124 causes both the automatic cinching arrangement 52 and the manual self-cinching arrangement 62 to be operable in a manner in accordance with that previously described above. During operation of the automatic cinching arrangement 54, the shoulder strap 124 displaces thereby communicating the displacement along the top restraint cinch handle strap segment 66 to the top restraint cinch strap 56. Depending on factors, such as the amount of preexisting slack, the magnitude of displacement of cinching arrangement 62 can be the same, different, proportional, or otherwise correspond to that of the shoulder strap 124. As displacement occurs, at some point, cinching of cinching arrangement 62 occurs, thereby causing the pocket contents 34 to be more securely and stably retained in the book sling pocket 32, preferably in a manner at least consistent with that discussed above.

While the preferred embodiment of the invention is a strap-supported, shoulder or back carried book holder, preferably a book sling, it is recognized that the present invention, namely one or both of the cinching arrangements 52 and/or 62 can be implemented in a backpack, a rucksack, a haversack, knapsack or the like. For example, where implemented in a backpack, either the auto cinching arrangement 52, the self cinching arrangement 62 or both the auto cinching arrangement and the self cinching arrangement can be included and incorporated into the backpack in a manner the same as or like that shown in the drawing figures. While the strap-supported, shoulder or back carried backpack, rucksack, haversack, knapsack, book sling, book holder, etc. can be implemented as a bag, it can be implemented as a case or another type of holder that is strap-supported and shoulder or back carried.

Various alternatives are contemplated as being within the scope of the following claims particularly pointing out and distinctly claiming the subject miter regarded as the invention. Thus, it is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the invention.

It is claimed:

1. A back or shoulder carried bag or case that includes a support strap supported on part of a back or shoulder of a person carrying the bag or case comprising: a back support surface disposed toward the back of the person and a wall portion; wherein said back support surface includes a support strap cinching arrangement, said support strap cinching arrangement comprising a primary cinch strap segment which extends dorsally within an inner pocket of said back support surface and wherein said primary cinch strap segment is connected to a bottom restraint strap and to a pair of flexible straps with one of the straps extending laterally relative to the back support surface through a slot in said back support surface and engages said wall portion and the other one of the straps extending longitudinally relative to the back support surface through a slot in said back support surface and engages said wall portion and wherein at least one of the flexible straps engages a portion of the back support surface and wherein both of said flexible straps are slidably movable in a lateral and longitudinal direction relative thereto in response to a force exerted upon said support strap acting in a direction opposed to a gravitational force.

2. The back or shoulder carried bag or case of claim 1 wherein the support strap comprises a shoulder strap that communicates with the support strap cinching arrangement.

3. The back or shoulder carried bag or case of claim 2 wherein the shoulder strap is integral with the support strap cinching arrangement.

4. The back or shoulder carried bag or case of claim 1 wherein the support strap cinching arrangement is integral with part of the bag or case.

5. The back or shoulder carried bag or case of claim 4 wherein the back support surface comprises a back panel disposed between the back of the person carrying the bag or case and between the person and an article carrying compartment of the bag or case and wherein at least part of the support strap cinching arrangement is disposed within or carried by the back panel.

6. The back or shoulder carried bag or case of claim 5 wherein the support strap comprises a flexible shoulder strap or belt, the back panel is of multi-layer construction, and the cinching arrangement comprises a plurality of straps or belts, at least a portion of each of which is carried by the back panel and is capable of movement relative to the back panel.

7. The back or shoulder carried bag or case of claim 6 wherein the support strap comprises a shoulder strap that communicates with the support strap cinching arrangement.

8. The back or shoulder carried bag or case of claim 7 wherein the shoulder strap is integral with the support strap cinching arrangement.

* * * * *